US007088172B1

(12) United States Patent
Lesea et al.

(10) Patent No.: US 7,088,172 B1
(45) Date of Patent: Aug. 8, 2006

(54) CONFIGURABLE VOLTAGE BIAS CIRCUIT FOR CONTROLLING BUFFER DELAYS

(75) Inventors: Austin H. Lesea, Los Gatos, CA (US); Patrick J. Crotty, San Jose, CA (US)

(73) Assignee: Xilinx, Inc., San Jose, CA (US)

( * ) Notice: Subject to any disclaimer, the term of this patent is extended or adjusted under 35 U.S.C. 154(b) by 0 days.

(21) Appl. No.: 10/360,465

(22) Filed: Feb. 6, 2003

(51) Int. Cl.
*G05F 1/10* (2006.01)
*G05F 3/02* (2006.01)

(52) U.S. Cl. ..... 327/543; 327/276; 327/513

(58) Field of Classification Search ..... 327/530, 327/538, 540, 541, 543, 407, 408, 276, 277, 327/158, 512–513
See application file for complete search history.

(56) References Cited

U.S. PATENT DOCUMENTS 4,810,948 A * 3/1989 Takuma ..... 323/280
5,682,352 A * 10/1997 Wong et al. ..... 365/201
5,808,576 A * 9/1998 Chloupek et al. ..... 341/144
5,933,039 A * 8/1999 Hui et al. ..... 327/262
6,137,482 A * 10/2000 Kim ..... 345/179
6,225,992 B1 * 5/2001 Hsu et al. ..... 345/211
6,229,364 B1 * 5/2001 Dortu et al. ..... 327/158
6,259,293 B1 * 7/2001 Hayase et al. ..... 327/276
6,384,762 B1 * 5/2002 Brunolli et al. ..... 341/144
6,404,274 B1 * 6/2002 Hosono et al. ..... 327/538
6,445,238 B1 9/2002 Lesea ..... 327/262
6,486,818 B1 * 11/2002 Nicholson et al. ..... 341/154

* cited by examiner

*Primary Examiner*—Quan Tra
(74) *Attorney, Agent, or Firm*—Edward S. Mao; LeRoy D. Maunu

(57) ABSTRACT

A configurable voltage bias circuit is used to control gate delays in buffers by adjusting the supply voltage of the buffers. The programmable voltage bias circuit includes a configurable voltage divider, which receives an input supply voltage and generates an output supply voltage, and a configurable resistance circuit, which is coupled between the configurable voltage divider and ground. By using a temperature dependent reference voltage to generate the input supply voltage, the output supply voltage is also made to be dependent upon temperature. The programmable voltage bias circuit of the present invention uses the temperature dependence of the output supply voltage to make the gate delays of the buffer temperature-independent.

20 Claims, 8 Drawing Sheets

CONFIGURABLE VOLTAGE BIAS CIRCUIT FOR CONTROLLING BUFFER DELAYS

FIELD OF THE INVENTION

The present invention relates to digital clocking circuits for digital electronics. More specifically, the present invention relates to a programmable voltage bias circuit, which can be used to control buffer delays.

BACKGROUND OF THE INVENTION

Synchronous digital systems, including board level systems and chip level systems, rely on one or more clock signals to synchronize elements across the system. Typically, one or more clock signals are distributed across the system on one or more clock lines. However, due to various problems such as clock buffer delays, high capacitance of heavily loaded clock lines, and propagation delays, the edges of a clock signal in different parts of the system may not be synchronized. The time difference between a rising (or falling) edge in one part of the system with the corresponding rising (or falling) edge in another part of the system is referred to as "clock skew".

Clock skew can cause digital systems to malfunction. For example, it is common for circuits in digital systems to have a first flip-flop output driving a second flip-flop input. With a synchronized clock signal on the clock input terminal of both flip-flops, the data in the first flip-flop is successfully clocked into the second flip-flop. However, if the active edge on the second flip-flop is delayed by clock skew, the second flip-flop might not capture the data from the first flip-flop before the first flip-flop changes state.

Delay lock loops are used in digital systems to minimize clock skew. Delay lock loops typically use delay elements to synchronize the active edges of a reference clock signal in one part of the system with a feedback clock signal from a second part of the system. FIG. 1 shows a block diagram of a conventional delay lock loop 100 coupled to logic circuits 190. Delay lock loop 100, which comprises a tuneable delay line 110 and a phase detector 120, receives a reference clock signal REF_CLK and drives an output clock signal O_CLK.

Tuneable delay line 110 delays reference clock signal REF_CLK by a variable propagation delay D before supplying output clock signal O_CLK. Thus, each clock edge of output clock signal O_CLK lags a corresponding clock edge of reference clock signal REF_CLK by propagation delay D. Phase detector 120 controls tuneable delay line 110, as described below.

Before output clock signal O_CLK reaches logic circuits 190, output clock signal O_CLK is skewed by clock skew 180. Clock skew 180 can be caused by delays in various clock buffers (not shown) or propagation delays on the clock signal line carrying output clock signal O_CLK (e.g., due to heavy loading on the clock signal line). To distinguish output clock signal O_CLK from the skewed version of output clock signal O_CLK, the skewed version is referred to as skewed clock signal S_CLK. Skewed clock signal S_CLK drives the clock input terminals (not shown) of the clocked circuits within logic circuits 190. Skewed clock signal S_CLK is also routed back to delay lock loop 100 on a feedback path 170. Typically, feedback path 170 is dedicated specifically to routing skewed clock signal S_CLK to delay lock loop 110. Therefore, any propagation delay on feedback path 170 is minimal and causes only negligible skewing.

Phase detector 120 controls delay line 110 to regulate propagation delay D. The actual control mechanism for delay lock loop 100 can differ. For example, in one version of delay lock loop 100, delay line 110 starts with a propagation delay D equal to minimum propagation delay D_MIN, after power-on or reset. Phase detector 110 then increases propagation delay D until reference clock signal REF_CLK is synchronized with skewed clock signal S_CLK. In another system, delay lock loop 100 starts with a propagation delay D equal to the average of minimum propagation delay D_MIN and maximum propagation delay D_MAX, after power-on or reset. Phase detector 120 then determines whether to increase or decrease (or neither) propagation delay D to synchronize reference clock signal REF_CLK with skewed clock signal S_CLK.

After synchronizing reference clock signal REF_CLK and skewed clock signal S_CLK, delay lock loop 100 monitors reference clock signal REF_CLK and skewed clock signal S_CLK and adjusts propagation delay D to maintain synchronization. A common reason for loss of synchronization is due to temperature changes in the system using delay lock loop 100. The changes in temperature also effects timing in tuneable delay line 110. Specifically, tuneable delay line 110 is generally formed by a series of buffer stages. FIG. 2 shows a typical tuneable delay line 200 having a multi-tap delay circuit 210 formed by plurality of buffer stages 210_1, 210_2, . . . 210_M, and a multiplexer 220. An input signal IN is received on the input terminal of buffer stage 210_1. The output terminal of each buffer stage 210_X is coupled to the input terminal of buffer stage 210_(X+1) as well as to an input terminal of multiplexer 220, where X is an integer between 1 and M−1, inclusive. The output terminal of buffer 210_M is coupled to an input terminal of multiplexer 210. For clarity, the output signal of a buffer stage 210_X is denoted as delayed output signal D_O[X], where X is an integer from 1 to M. Tap select signals TS selects one of the delayed output signals as output signal OUT of tuneable delay line 200.

In general each buffer stage is identical and provides a base delay B_D. Thus, delayed output signal D_O[X] is a copy of input signal IN delayed by X times base delay B_D. FIG. 3 illustrates a typical buffer stage 300. Buffer stage 300 includes a first inverter 310 and a second inverter 320 coupled in series. First inverter 310 includes a PMOS transistor 313 and an NMOS transistor 317 coupled in series between the positive supply voltage VCC and ground. Similarly, second inverter 320 includes a PMOS transistor 323 and an NMOS transistor 327 coupled in series between the positive supply voltage VCC and ground. The gate delays of transistors 313, 317, 323, and 327 provide base delay B_D. However, the gate delay of a transistor is dependent on the fabrication process. For example, factors such as implant and threshold voltage levels, which may vary somewhat between wafers, affect the gate delay of the transistors. Thus, base delay B_D may differ between different instances of tuneable delay line 200. Furthermore, the gate delay of a transistor is also dependent on temperature. In general, as temperature increases, gate delays (and thus base delay B_D) also increases. Similarly, as temperature decreases, gate delays (and thus base delay B_D) also decreases.

If base delay B_D becomes very small, maximum propagation delay D_MAX of tuneable delay line 110 (FIG. 1) may not be large enough compensate for clock skew 180. Conversely, if base delay B_D becomes too large, minimum propagation delay D_MIN of tuneable delay line 110 may not be small enough to compensate for clock skew 180. In addition if base delay B_D is large, delay lock loop 100 may introduce unacceptable jitter in output clock signal O_CLK. Hence, there is a need for circuit and method to adjust the propagation delay of a buffer stage to compensate for temperature and process variations.

SUMMARY

Accordingly, a voltage control circuit provides the supply voltage to a buffer stage. The voltage control circuit adjusts the supply voltage of the buffer stage in response to temperature changes so that the buffer stage has a substantially constant gate delay. Specifically, the effect of decreasing temperature is compensated by decreasing the supply voltage. Similarly, the effect of increasing temperature is compensated by increasing the supply voltage.

In one embodiment of the present invention, a programmable voltage bias circuit includes a temperature sensitive reference voltage source, and a configurable voltage divider circuit. The configurable voltage bias circuit includes a configurable voltage divider that receives an input supply voltage from the temperature reference voltage source and generates an output supply voltage. The configurable bias circuit also includes a configurable resistance circuit coupled between the configurable voltage divider and ground.

In some embodiment of the present invention, the configurable voltage divider provides a first configurable resistance and a second configurable resistance. The configurable resistance circuit further provides a third configurable resistance. In these embodiment the output supply voltage is equal to the input supply voltage multiplied by the sum of the second configurable resistance and the third configurable resistance divided by the sum of the first configurable resistance, the second configurable resistance, and the third configurable resistance.

The output supply voltage can be used as the supply voltage for buffers. If the input supply voltage is generated by a temperature dependent reference voltage circuit, the propagation delay of the buffers can become temperature invariant.

The present invention will be more fully understood in view of the following description and drawings.

DETAILED DESCRIPTION

As explained above, propagation delay of buffer stages vary with temperature. The present invention compensates for temperature variations by adjusting the supply voltage to the buffer stage in response to temperature fluctuations. Specifically, the propagation delay of a buffer stage is inversely proportional with the supply voltage provided to the transistor. Thus, increasing the supply voltage decreases the propagation delay; and decreasing the supply voltage increases the propagation delay. The principles of the present invention may also be applied to other logic circuits, such as buffers, inverters, AND gates, NAND gates, OR gates, NOR gates, XOR gates, and XNOR gates, to compensate for temperature variations.

Figure 1:
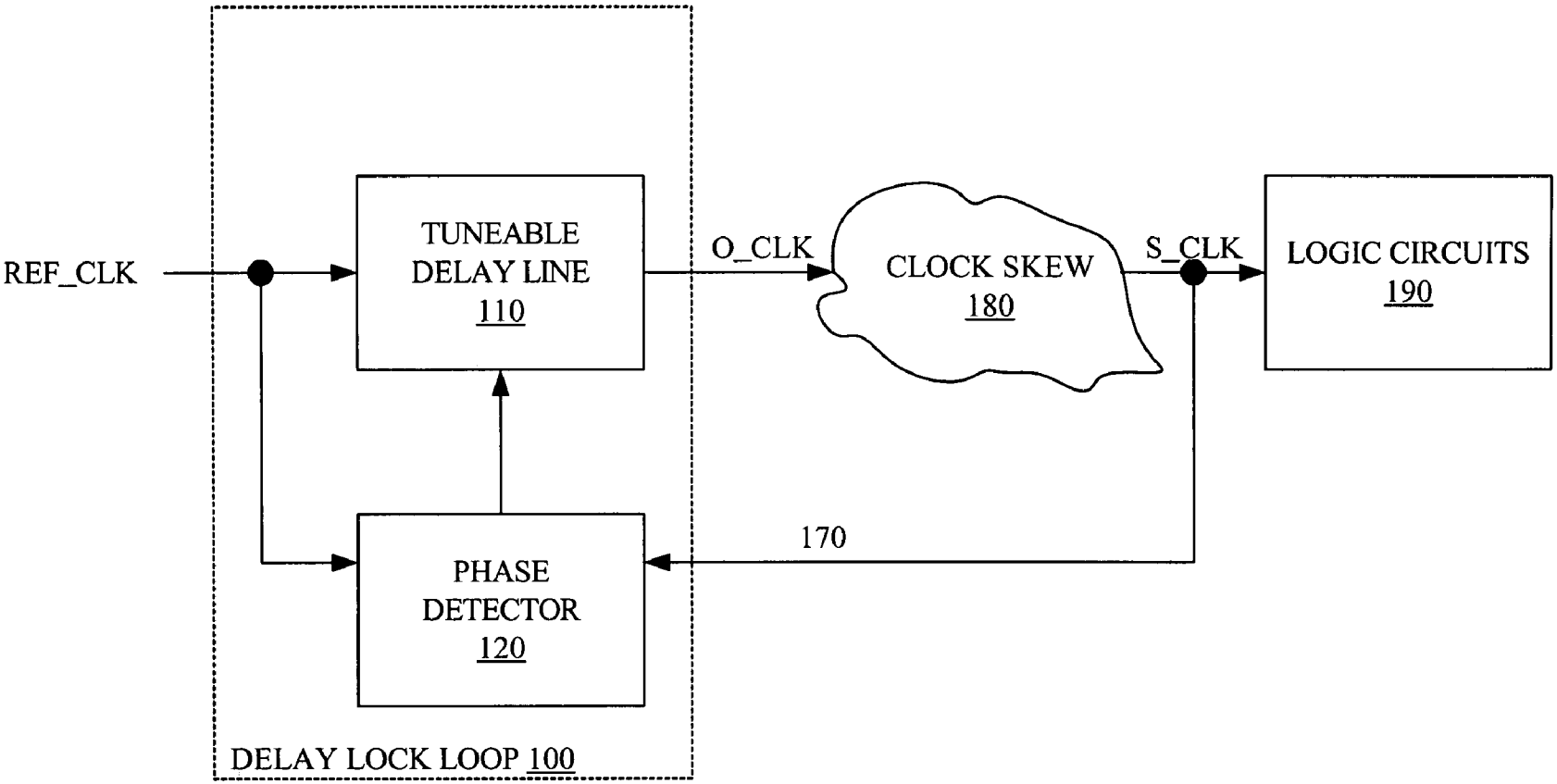
FIGURE 1 (Prior Art)
FIG. 1 is a block diagram of a conventional delay locked loop.
Figure 2:
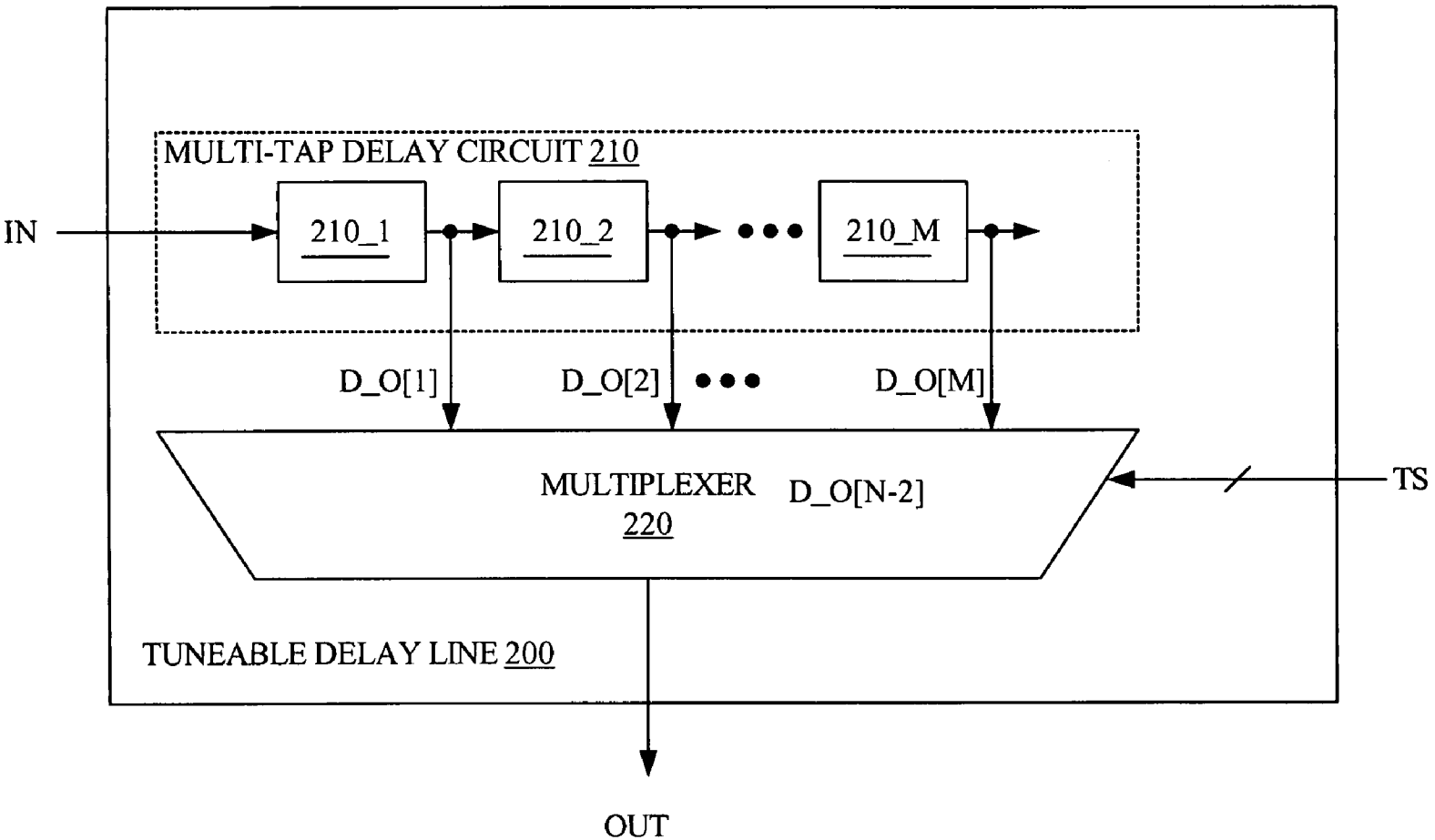
FIG. 2 is a block diagram of a tuneable delay line.
Figure 3:
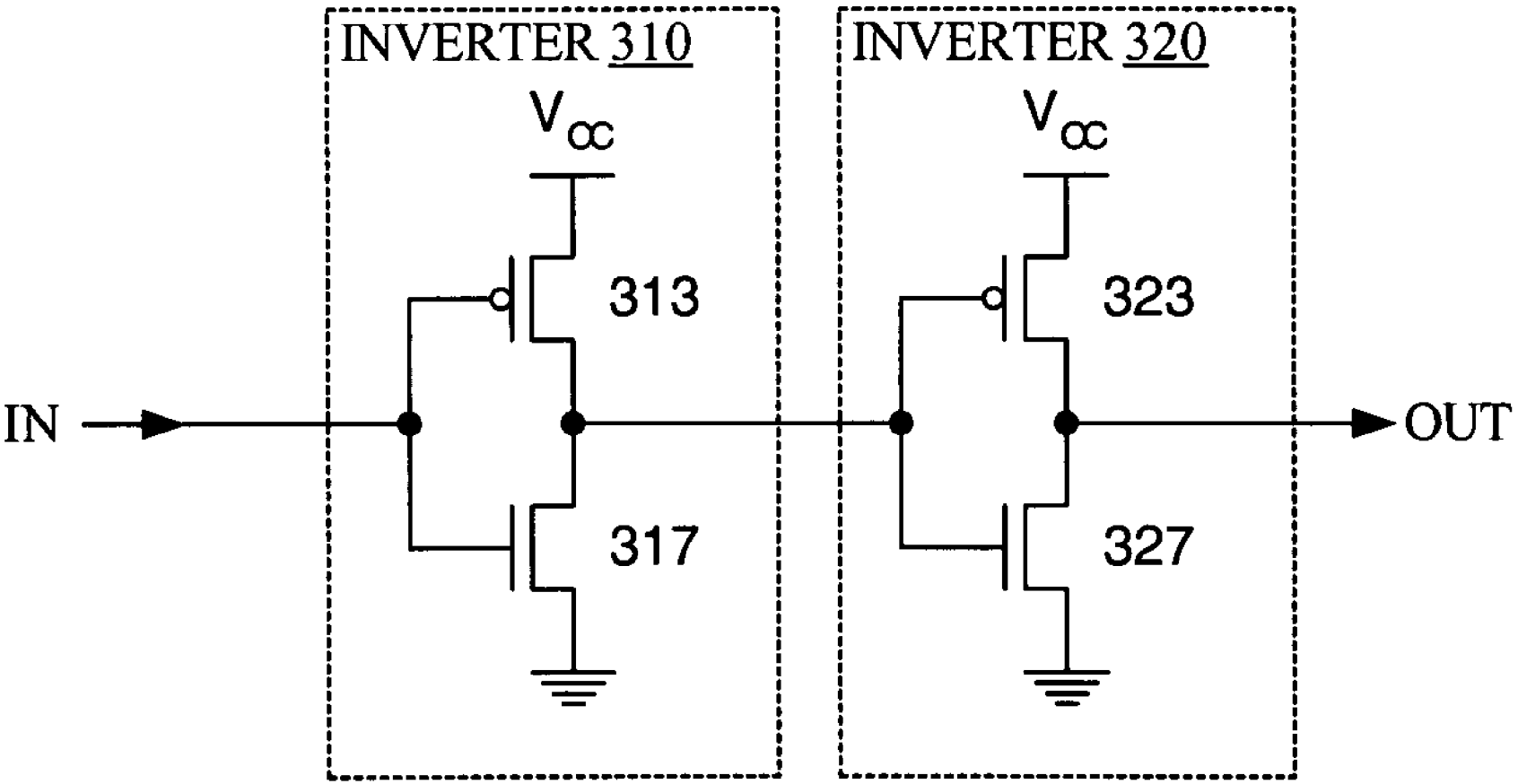
FIG. 3 is a circuit diagram of a buffer stage.
Figure 4:
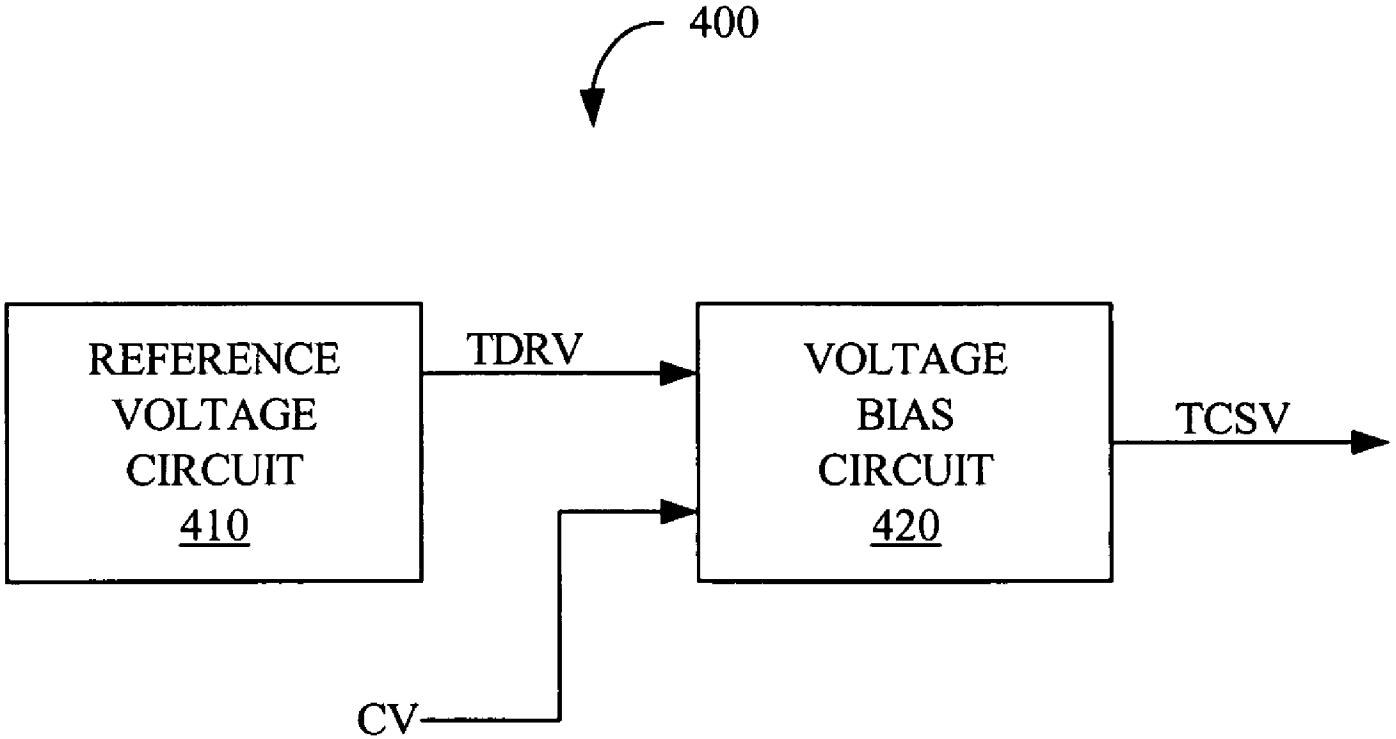
FIG. 4 is a block diagram of reference voltage circuit and a configurable voltage bias circuit in accordance with one embodiment of the present invention.

FIG. 4 is a block diagram of a temperature compensated voltage supply 400 in accordance with one embodiment of the present invention. Temperature compensated voltage supply 400 includes a reference voltage circuit 410 and a configurable voltage bias circuit 420. Reference voltage circuit 410 provides a temperature dependent reference voltage TDRV to configurable voltage bias circuit 420. Configurable voltage bias circuit 420 adjusts temperature dependent reference voltage TDRV to generate temperature compensated supply voltage TCSV. As illustrated in FIG. 4, in some embodiments of the present invention, configurable voltage bias circuit 420 may also receive a control voltage CV.

Reference voltage circuit 410 is configured to generate temperature dependent reference voltage TDRV to vary with temperature. Specifically, temperature dependent reference voltage TDRV increases as the temperature increases. Conversely, temperature dependent reference voltage TDRV decreases as the temperature decreases. A well-known circuit which can be used as reference voltage circuit 410 is a band gap reference circuit. Band gap reference circuits are well-known in the art and not described in detail herein. For example, a band gap reference circuit is described in U.S. Pat. No. 6,445,238, entitled "Method and Apparatus for Adjusting Delay in a Delay Locked Loop for Temperature Variations", by Austin Lesea, which is incorporated herein by reference. Other embodiments of the present invention may use other reference voltage circuits.

Figure 5:
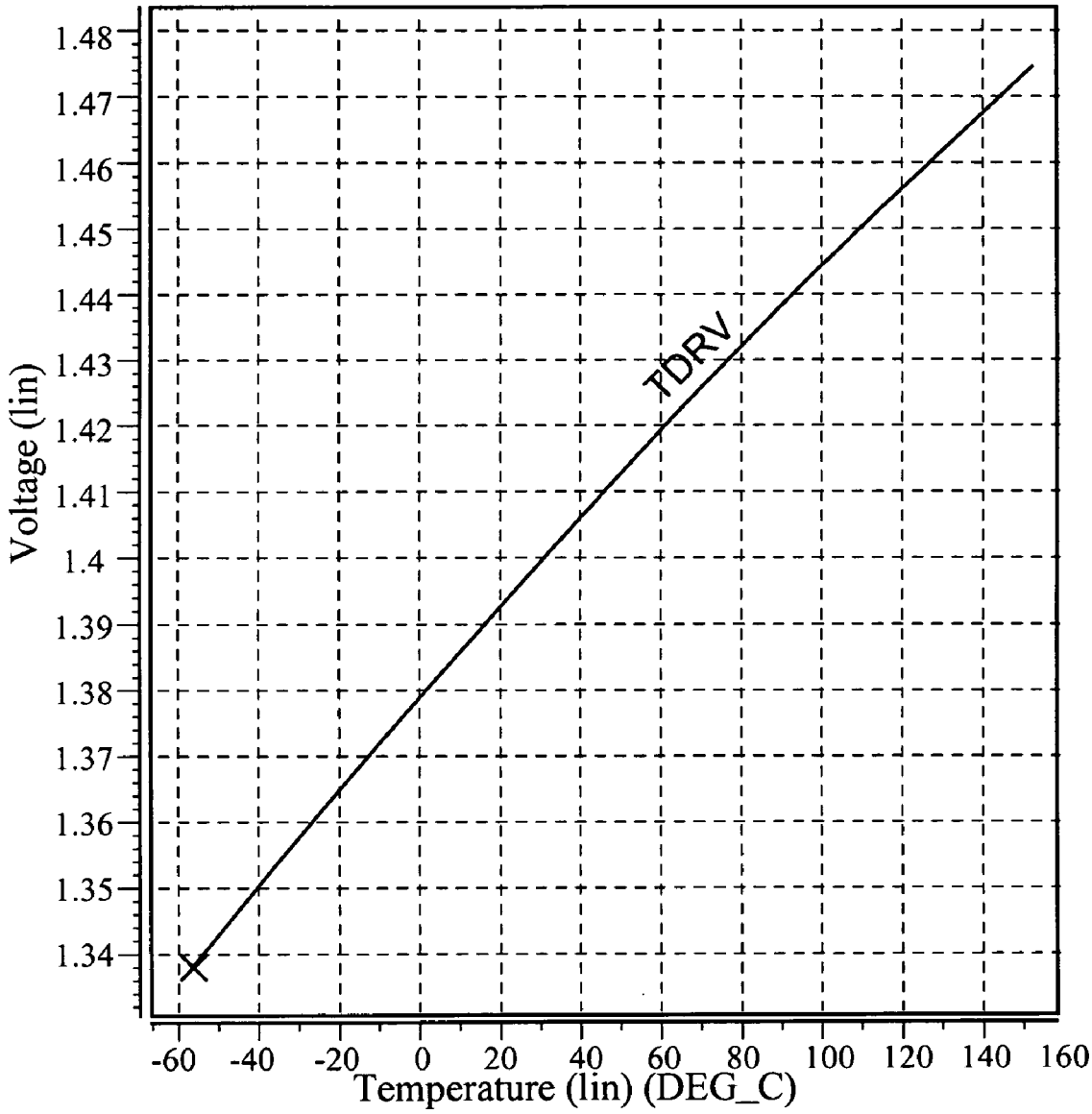
FIG. 5 is a voltage/temperature graph for a reference voltage circuit.

FIG. 5 is an idealized voltage/temperature graph for temperature dependent reference voltage TDRV. As illustrated in FIG. 5, temperature dependent reference voltage TDRV is roughly linear with a positive slope.

As explained above, the propagation delay of a buffer stage varies depending on process variations and temperature. Furthermore, reference voltage circuit 410 may also suffer from process variations so that slope and temperature may be different in different instances of reference voltage circuit 410. The present invention uses configurable voltage bias circuit 420 to compensate for these variations. Specifically, configurable voltage bias circuit 420 can be configured to modify the slope and voltage level of temperature dependent reference voltage TDRV in generating temperature compensated supply voltage TCSV.

Figure 6:
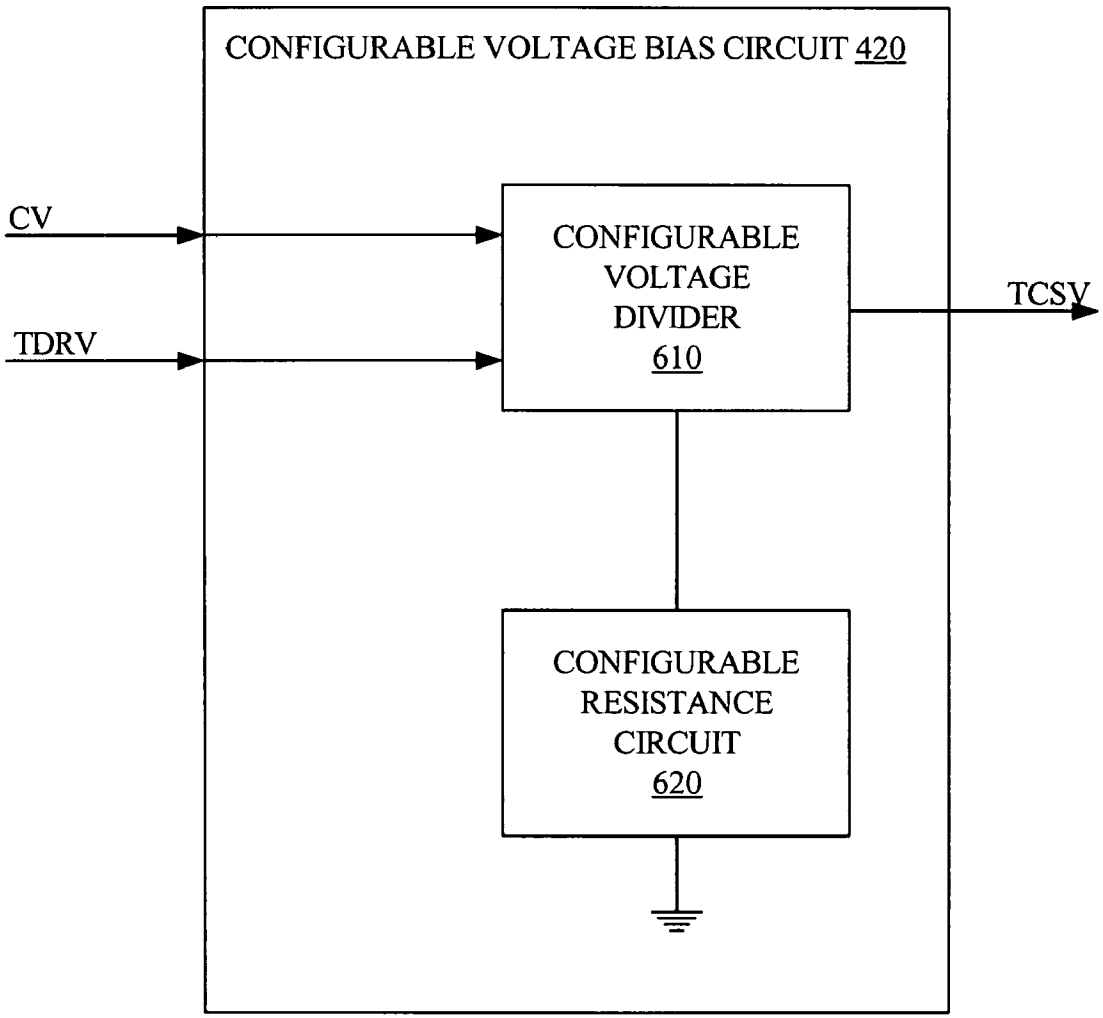
FIG. 6 is a block diagram of a configurable voltage bias circuit in accordance with one embodiment of the present invention.

FIG. 6 shows an embodiment of configurable voltage bias circuit 420 in accordance with one embodiment of the present invention. The embodiment of FIG. 6 includes a configurable voltage divider 610 and a configurable resistance circuit 620. Specifically, temperature dependent reference voltage TDRV is provided to configurable voltage divider 610. Configurable voltage divider 610 is coupled to ground through configurable resistance circuit 620, which provides a resistance R620. Configurable voltage divider 610 is configurable to have a first resistance R610_1 and a second resistance R610_2. Temperature compensated supply voltage is equal to temperature dependent reference voltage multiplied by the sum of resistance R610_2 plus resistance R620 divided by the sum of resistance R610_1 plus resistance R610_2 plus resistance R620. In equation form $$TCSV=TDRV*(R610_2+R620)/(R610_1+R610_2+R620).$$

In embodiments of the present invention using control voltage CV, configurable voltage divider 610 can be configured to set temperature compensated supply voltage TCSV to equal control voltage CV. In some embodiments of the present invention configurable resistance circuit 620 is omitted in configurable voltage bias circuit 420. Furthermore, some embodiments of the present invention may include additional resistance circuits between configurable voltage divider 610 and configurable resistance circuit 620.

Figure 7:
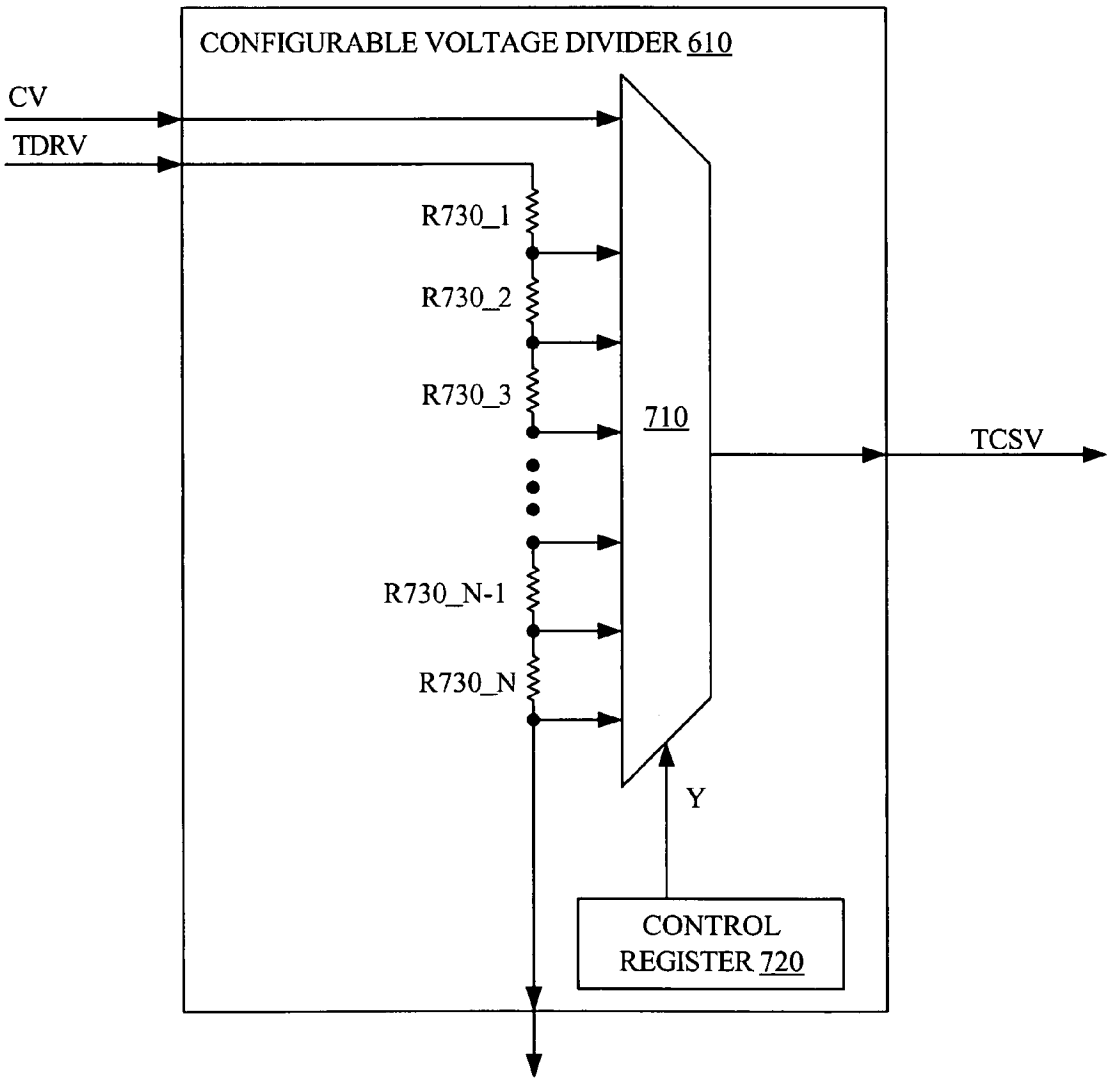
FIG. 7 is a block diagram of a configurable voltage divider in accordance with one embodiment of the present invention.

FIG. 7 is an embodiment of Configurable voltage divider 610. The embodiment of FIG. 7 includes a multiplexer 710, a control register 720, and a plurality of resistors R730_1, R730_2, R730_3, . . . R730_N−1, R730_N. For simplicity, resistors R730_1 to R730_N have the same resistance R730. Other embodiments of the present invention may use resistors having different resistances. Temperature dependent reference voltage TDRV is applied to a first terminal of resistor R730_1. Resistors R730_1 to R730_N are coupled in series. Specifically, a first terminal of resistor R730_X is coupled to a second terminal of resistor R730_X−1, where X is an integer from 2 to N, inclusive. The second terminal of resistor R730_N is coupled to ground through configurable resistance circuit 620 (FIG. 6). The second terminal of each resistor R730_1 to R730_N is coupled to an input terminal of multiplexer 710. Control voltage CV is also applied to an input terminal of multiplexer 710. The output terminal of multiplexer 710 provides temperature compensated supply voltage TCSV. A control register 720, which is user configurable, controls multiplexer 710.

In the embodiment of FIG. 7, if control register 720 is configured with a value of zero, temperature compensated supply voltage is equal to control voltage CV. If control register 720 is configured with a value Y, first resistance R610_1 is equal to Y multiplied by resistance R730 and second resistance R610_2 is equal to (N−Y) multiplied by resistance R730. Thus, temperature compensated supply voltage TCSV is equal to temperature dependent reference voltage TDRV multiplied by the sum of resistance R620 (from configurable resistance circuit 620) plus (N−Y) multiplied by resistance R730 divided by the sum of resistance R620 plus N time resistance R730, that is $$TCSV=TDRV*(R620+(N-Y)*R730)/(R620+N*R730).$$

Thus, the slope of temperature compensated supply voltage TCSV can be modified by configuring configurable voltage divider 610 and configurable resistance circuit 620 (as described below).

Figure 8:
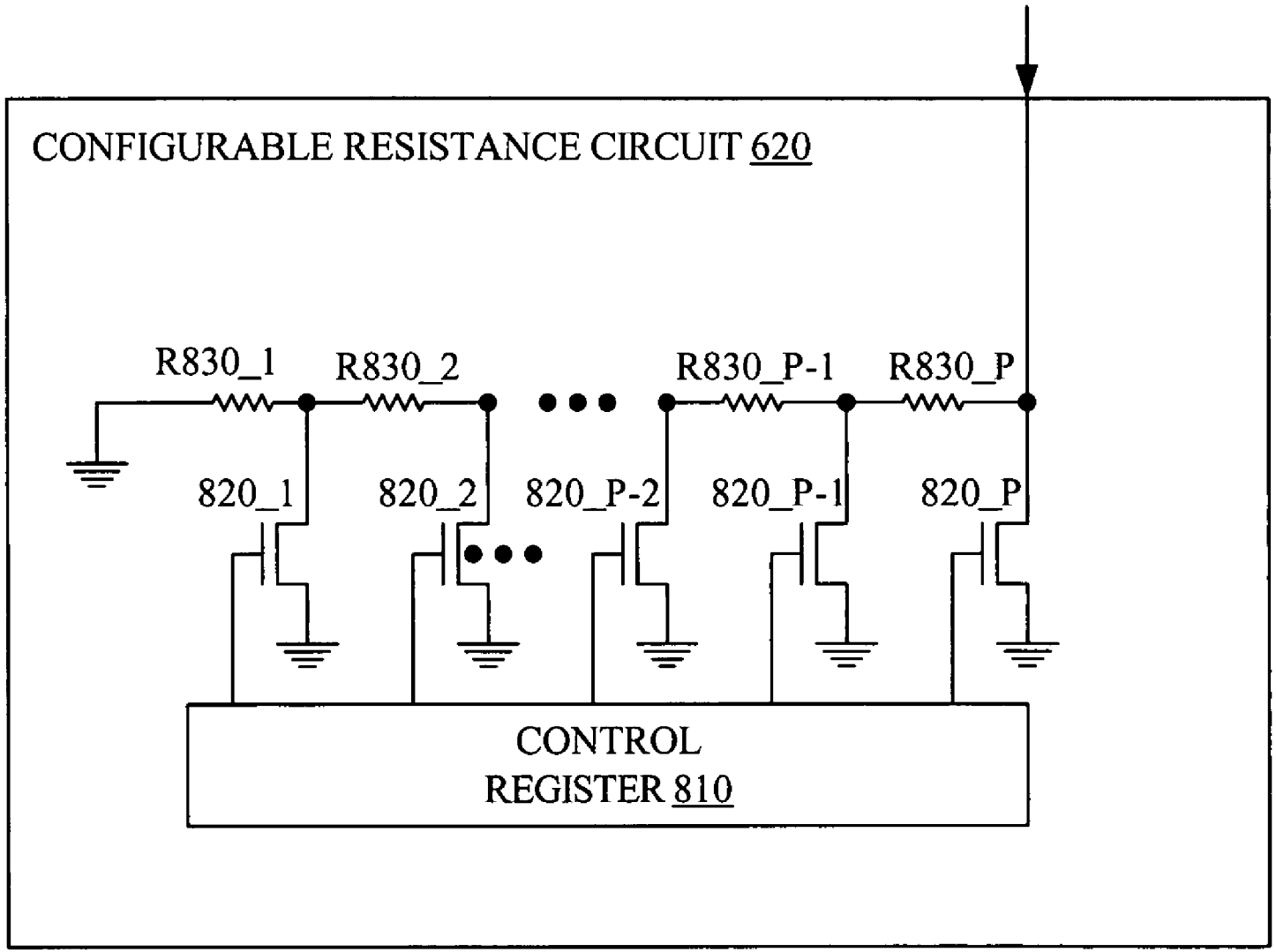
FIG. 8 is a block diagram of a configurable resistance circuit in accordance with one embodiment of the present invention.

FIG. 8 is a block diagram of an embodiment of configurable resistance circuit 620. The embodiment of FIG. 8 includes a control register 810, a plurality of transistors 820_1 to 820_P, and a plurality of resistors 830_1 to 830_P. For clarity, resistors 830_1 to 830_P all have a resistance R820. Other embodiments of the present invention may use resistors having different resistances. Configurable voltage divider 610 (FIG. 6) is coupled to a first terminal of resistor R830_P. Resistors R830_1 to R830_P are coupled in series. Specifically, a first terminal of resistor R830_X is coupled to a second terminal of resistor R830_X+1, where X is an integer from 1 to P−1, inclusive. The second terminal of resistor R830_1 is coupled to ground. The first terminal of each resistor R830_1 to R830_P is coupled to ground through transistors 820_1 to 820_P, respectively. Control register 810 has P control bits. For clarity, the control bits of control register 810 are referenced as control bits 810_1 to 810_P. Each control bit 810_X controls transistor 820_X, where X is an integer from 1 to P, inclusive. A logic high in a control bit 810_X activates transistor 820_X to electrically couple the first terminal of resistor R830_X to ground. In general, only one control bit of control register 810 should be set to logic high. However, if multiple control bits of control register 810 are at logic high, the highest order control bit determines resistance R620 of configurable resistance circuit 620. Specifically, if control bit 810_Z is the highest order control bit of control register 810, resistance R620 is equal to resistance R830 multiplied by (P−Z). Thus, R620=R830*(P−Z).

In the various embodiments of this invention, novel structures and methods have been described to compensate the propagation delay of a buffer stage for temperature variations. Specifically, a temperature dependent reference voltage is further modified by a configurable voltage divider, which can adjust the slope of the temperature dependent reference voltage to generate a temperature compensated supply voltage. Configurable resistance circuits can also be included to further control the temperature compensated supply voltage. The various embodiments of the structures and methods of this invention that are described above are illustrative only of the principles of this invention and are not intended to limit the scope of the invention to the particular embodiments described. For example, in view of this disclosure, those skilled in the art can define other delay locked loops, tuneable delay lines, buffer stages, temperature compensated voltage supplies, configurable voltage bias circuits, configurable voltage dividers, configurable resistance circuits, resistors, and so forth, and use these alternative features to create a method or system according to the principles of this invention. Thus, the invention is limited only by the following claims.

What is claimed is:

1. A configurable voltage bias circuit coupled to control the propagation delay of a logic circuit, the configurable voltage bias circuit comprising:

a temperature dependent reference voltage circuit configured to generate a temperature dependent reference voltage that increases as temperature increases;

a plurality of resistors connected in series between the temperature dependent reference voltage and a low supply voltage, wherein the plurality of resistors includes a first set of resistors and a second set of resistors;

a configurable voltage divider coupled to receive the temperature dependent reference voltage and configured to generate an output supply voltage for the logic circuit, wherein the configurable voltage divider comprises a multiplexer having inputs connected to terminals of the first set of resistors and an output driving the output supply voltage, the multiplexer selecting a portion of the first set of resistors in response to a first control word, the configurable voltage divider including a first configurable resistance and a second configurable resistance having resistance magnitudes that are directly proportional to the number of resistors in the first set of resistors; and a configurable resistance circuit coupled between the configurable voltage divider and the low supply voltage, wherein the configurable resistance circuit comprises a plurality of transistors connected between the low supply voltage and terminals of the second set of resistors, the transistors selecting a portion of the second set of resistors in response to a second control word, the second control word being independent of the first control word, the configurable resistance circuit including a third configurable resistance having a resistance magnitude that is directly proportional to the number of resistors in the third configurable resistance circuit.

2. The configurable voltage bias circuit of claim 1, wherein the output supply voltage is equal to the temperature dependent reference voltage multiplied by the sum of the second configurable resistance and the third configurable resistance and divided by the sum of the first configurable resistance, the second configurable resistance, and the third configurable resistance.

3. The configurable voltage bias circuit of claim 1, wherein the multiplexer is controllable by a register.

4. The configurable voltage bias circuit of claim 1, wherein the multiplexer comprises a controlled voltage input terminal coupled to a controlled voltage supply.

5. The configurable voltage bias circuit of claim 1, wherein the plurality of transistors are controllable by a register.

6. The configurable voltage bias circuit of claim 1, wherein the logic circuit is a buffer.

7. The configurable voltage bias circuit of claim 1, wherein the logic circuit is an inverter.

8. The configurable voltage bias circuit of claim 1, wherein the logic circuit is an NAND gate.

9. A method of controlling the propagation delay of a buffer, the method comprising:

generating a temperature dependent reference voltage that increases as temperature increases; and biasing the temperature dependent reference voltage to generate a temperature compensated supply voltage for the buffer, wherein the biasing the temperature dependent reference voltage to generate a temperature compensated supply voltage for the buffer comprises:

adjusting a first resistance;

adjusting a second resistance, wherein the first and second resistances are adjusted to be directly proportional to a number of resistors in the first and second resistances; and adjusting a third resistance, the third resistance being adjusted to be directly proportional to a number of resistors in the third resistance, wherein the temperature compensated supply voltage is equal to the temperature dependent reference voltage multiplied by the sum of the first resistance and the second resistance divided by the sum of the first resistance, the second resistance, and the third resistance, the first and second resistances being adjusted in response to a first control word and the third resistance being adjusted in response to a second control word independent of the first control word.

10. The method of claim 9, wherein the adjusting a first resistance and adjusting a second resistance comprises selecting a terminal of a resistor in a series of resistors to provide the temperature compensated supply voltage.

11. The method of claim 9, wherein the adjusting a third resistance comprises activating a transistor to ground terminal of a resistor from a series of resistors.

12. A system for controlling the propagation delay of a buffer, the system comprising:

means for generating a temperature dependent reference voltage that increases as temperature increases; and means for biasing the temperature dependent reference voltage to generate a temperature compensated supply voltage for the buffer, wherein the means for biasing the temperature dependent reference voltage to generate a temperature compensated supply voltage for the buffer comprises:

means for adjusting a first resistance;

means for adjusting a second resistance, wherein the first and second resistances are adjusted to be directly proportional to a number of resistors in the first and second resistances; and means for adjusting a third resistance, the third resistance being adjusted to be directly proportional to a number of resistors in the third resistance, wherein the temperature compensated supply voltage is equal to the temperature dependent reference voltage multiplied by the sum of the first resistance and the second resistance divided by the sum of the first resistance, the second resistance, and the third resistance, the first and second resistances being adjusted in response to a first control word and the third resistance being adjusted in response to a second control word independent of the first control word.

13. The system of claim 12, wherein the means for adjusting a first resistance and means for adjusting a second resistance comprises means for selecting a terminal of a resistor in a series of resistors to provide the temperature compensated supply voltage.

14. The system of claim 12, wherein the means for adjusting a third resistance comprises means for activating a transistor to ground terminal of a resistor from a series of resistors.

15. A configurable voltage bias circuit coupled to control the propagation delay of a logic circuit, the configurable voltage bias circuit comprising:

a temperature dependent reference voltage circuit configured to generate a first temperature dependent reference voltage that increases linearly as temperature increases;

a configurable voltage divider coupled to receive the first temperature dependent reference voltage and configured to generate an output supply voltage for the logic circuit, the configurable voltage divider including a multiplexer for receiving a first control value as well as a plurality of temperature dependent reference voltages provided by a voltage divider from the first temperature dependent reference voltage, the multiplexer being operative to combine a portion of the temperature dependent reference voltages in response to the first control value, wherein the configurable voltage divider includes a first configurable resistance and a second configurable resistance having resistance magnitudes that are directly proportional to a number of resistors in the first and second configurable resistances; and a configurable resistance circuit coupled between the configurable voltage divider and a low supply voltage, wherein the configurable resistance circuit comprises a plurality of transistors connected between the low supply voltage and terminals of a set of resistors, and wherein the configurable resistance circuit provides a selectable resistance to the voltage divider, wherein the selectable resistance is controlled by a second control value independent of the first control value, and wherein the configurable resistance circuit includes a third configurable resistance having a resistance magnitude that is directly proportional to a number of resistors in the third configurable resistance circuit.

16. The configurable voltage bias circuit of claim 15, wherein the output supply voltage is equal to the first temperature dependent reference voltage multiplied by the sum of the second configurable resistance and the third configurable resistance and divided by the sum of the first configurable resistance, the second configurable resistance, and the third configurable resistance.

17. The configurable voltage bias circuit of claim 15, wherein the configurable voltage divider comprises a first plurality of resistors coupled in series between the first temperature dependent reference voltage and the configurable resistance circuit.

18. The configurable voltage bias circuit of claim 17, wherein the multiplexer has a plurality of input terminals, a plurality of control terminals, and an output terminal driving the output supply voltage, wherein each of the plurality of input terminals is coupled to a first terminal of a resistor from the first plurality of resistors.

19. The configurable voltage bias circuit of claim 18, wherein the configurable resistance circuit comprises a second plurality of resistors coupled in series between the configurable voltage divider and ground.

20. The configurable voltage bias circuit of claim 19, wherein each of the plurality of transistors has a control terminal, a first power terminal coupled to a first terminal of a resistor from the second plurality of resistors, and a second terminal coupled to the low supply voltage.

* * * * *